US011512909B2

(12) United States Patent
Mahajan et al.

(10) Patent No.: US 11,512,909 B2
(45) Date of Patent: Nov. 29, 2022

(54) HEAT EXCHANGER FIN

(71) Applicant: Rheem Manufacturing Company, Atlanta, GA (US)

(72) Inventors: Govinda Mahajan, Montgomery, AL (US); Daniel Bacellar, Siler Spring, MD (US)

(73) Assignee: Rheem Manufacturing Company, Atlanta, GA (US)

( * ) Notice: Subject to any disclaimer, the term of this patent is extended or adjusted under 35 U.S.C. 154(b) by 77 days.

(21) Appl. No.: 17/174,454

(22) Filed: Feb. 12, 2021

(65) Prior Publication Data

US 2021/0239410 A1 Aug. 5, 2021

Related U.S. Application Data

(63) Continuation of application No. 16/352,298, filed on Mar. 13, 2019, now Pat. No. 10,921,065.

(60) Provisional application No. 62/804,037, filed on Feb. 11, 2019, provisional application No. 62/643,050, filed on Mar. 14, 2018.

(51) Int. Cl.

| | |
|---|---|
| ***F28F 1/32*** | (2006.01) |
| ***F28B 1/06*** | (2006.01) |
| ***F28F 1/06*** | (2006.01) |
| ***F28F 3/02*** | (2006.01) |
| ***F28F 9/013*** | (2006.01) |

(52) U.S. Cl.

CPC ..... *F28F 1/32* (2013.01); *F28B 1/06* (2013.01); *F28F 1/06* (2013.01); *F28F 3/027* (2013.01); *F28F 9/013* (2013.01)

(58) Field of Classification Search

CPC ..... H01L 23/3672; F28F 13/12; F28F 1/06; F28F 1/325; F28F 1/32; F28F 1/128

See application file for complete search history.

(56) References Cited

U.S. PATENT DOCUMENTS

| | | | | |
|---|---|---|---|---|
| 1,416,570 A * | 5/1922 | Modine | F28F 1/325 | 165/151 |
| 1,743,861 A * | 1/1930 | Modine | F28F 1/325 | 165/151 |
| 2,246,258 A * | 6/1941 | Lehman | B21C 37/24 | 165/151 |
| 4,723,599 A * | 2/1988 | Hanson | F28F 1/325 | 165/181 |
| 5,099,914 A * | 3/1992 | Reifel | F28F 1/325 | 165/151 |

(Continued)

FOREIGN PATENT DOCUMENTS

| | | |
|---|---|---|
| CN | 2532331 A1 * | 1/2006 |
| CN | 106662406 A | 5/2017 |

(Continued)

OTHER PUBLICATIONS

FR 2866698 mt (Year: 2005).*

First Office Action of Chinese Application No. 201910192528.6 dated Jan. 19, 2022. (18 pages).

*Primary Examiner* — Gordon A Jones

(74) *Attorney, Agent, or Firm* — Eversheds Sutherland (US) LLP

(57) ABSTRACT

Heat exchanger fins and heat exchangers are disclosed. The heat exchanger fins disclosed herein comprise louvers and winglet-type vortex generators arranged to improve heat transfer efficiency.

11 Claims, 5 Drawing Sheets

(56) References Cited

U.S. PATENT DOCUMENTS

| | | | | | |
|---|---|---|---|---|---|
| 5,318,112 | A * | 6/1994 | Gopin | F28D 1/05366 165/910 |
| 5,853,047 | A * | 12/1998 | Kim | F28F 1/325 165/906 |
| 6,349,761 | B1 * | 2/2002 | Liu | F28F 13/12 165/181 |
| 7,552,760 | B1 * | 6/2009 | Ben Lakhdhar | F28F 13/06 165/182 |
| 8,490,680 | B2 * | 7/2013 | Shen | F28F 1/325 165/181 |
| 9,638,476 | B2 * | 5/2017 | Kerler | F28F 1/325 |
| 9,958,215 | B2 * | 5/2018 | Buckrell | F28F 1/128 |
| 2016/0273850 | A1 | 9/2016 | Okamoto et al. | |

FOREIGN PATENT DOCUMENTS

| | | | | |
|---|---|---|---|---|
| FR | 2866698 | A1 * | 8/2005 | F28F 1/325 |
| JP | H09152288 | A | 6/1997 | |
| WO | 2015188812 | A1 | 12/2015 | |

* cited by examiner

HEAT EXCHANGER FIN

PRIORITY CLAIM

The present application claims priority to U.S. Provisional Patent Application No. 62/643,050 filed Mar. 14, 2018 and titled "Heat Exchanger Fin," and claims priority to U.S. Provisional Patent Application No. 62/804,037 filed Feb. 11, 2019 and titled "Heat Exchanger Fin". The entire contents of the foregoing applications are hereby incorporated herein by reference.

TECHNICAL FIELD

Embodiments of the technology relate generally to heat exchanger fins as well as heat exchangers and methods using the fins.

BACKGROUND

Finned heat exchanger coil assemblies are widely used in a number of applications in fields such as air conditioning, refrigeration, and tankless water heaters. A finned heat exchanger coil assembly generally includes a plurality of spaced parallel tubes through which a heat transfer fluid such as water or refrigerant flows. A second heat transfer fluid, usually flue gas, is directed across the exterior of the tubes. A plurality of fins is usually employed to improve the heat transfer capabilities of the heat exchanger coil assembly. Each fin is a thin metal plate, made of copper, copper alloys, titanium, aluminum, or stainless steel, for example. Each fin includes a plurality of apertures for receiving the spaced parallel tubes, such that the tubes generally pass through the plurality of fins at right angles to the fins. The fins are arranged in a parallel, closely-spaced relationship along the tubes to form multiple paths for the air or other heat transfer fluid to flow across the fins and around the tubes.

Often the fin includes one or more surface enhancements to improve the efficiency of heat transfer. For example, heat exchanger fins may include a corrugated or sinusoid-like shape when viewed in cross-section. In addition, or instead of, the smooth enhancement, heat exchanger fins may also include enhancements that protrude from the surface of the heat exchanger fins. Such enhancements can be formed out of a finstock (the plane of the fin material out of which all fin features are formed).

The foregoing background information is provided to reveal information believed by the applicant to be of possible relevance to the present disclosure. No admission is necessarily intended, nor should be construed, that any of the preceding information constitutes prior art against the present disclosure.

SUMMARY

The present disclosure is related to fin designs with improved heat transfer efficiency and heat exchangers comprising such fins.

In one aspect, the present disclosure relates to a heat exchanger fin comprising a base having a fin leading edge and a fin trailing edge and a substantially flat base plane extending between the fin leading edge and the fin trailing edge, wherein the fin is configured such that the fin leading edge is upstream of the fin trailing edge during use and wherein the base comprises a plurality of apertures each configured to receive a heat transfer tube; a first louver coupled to the base at a first end and a second end and comprising a leading edge and a trailing edge, wherein the first louver leading edge and the first louver trailing edge are spaced apart from the base plane a first distance; and a first winglet-type vortex generator coupled to the base and located between the fin leading edge and the first louver leading edge. The fin can also comprise a second winglet-type vortex generator also located between the fin leading edge and the first louver leading edge. The two vortex generators are oriented relative to each other to form an angle that opens up toward the first louver.

In another aspect, the present disclosure relates to a heat exchanger fin comprising a base having a fin leading edge and a fin trailing edge and a substantially flat base plane extending between the fin leading edge and the fin trailing edge, wherein the fin is configured such that the fin leading edge is upstream of the fin trailing edge during use and wherein the base comprises a plurality of apertures each configured to receive a heat transfer tube; a first louver coupled to the base at a first end and a second end and comprising a leading edge and a trailing edge, wherein the first louver leading edge and the first louver trailing edge are spaced apart from the base plane a first distance; and a second louver coupled to the base at a first end and a second end and located between the fin trailing edge and the first louver trailing edge, the second louver comprising a leading edge and a trailing edge, wherein the second louver leading edge and the second louver trailing edge are spaced apart from the base plane a second distance that is greater than the first distance. The fin can comprise two sets of stepped louvers arranged in alignment, parallel to each other, and extending perpendicular to the average direction of gas flow over the heat exchanger fin and around the exterior of the heat transfer tubes.

In another aspect, the disclosure relates to a heat exchanger incorporating the heat exchanger fins described herein.

These and other aspects will be described further in the example embodiments set forth herein.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1A:
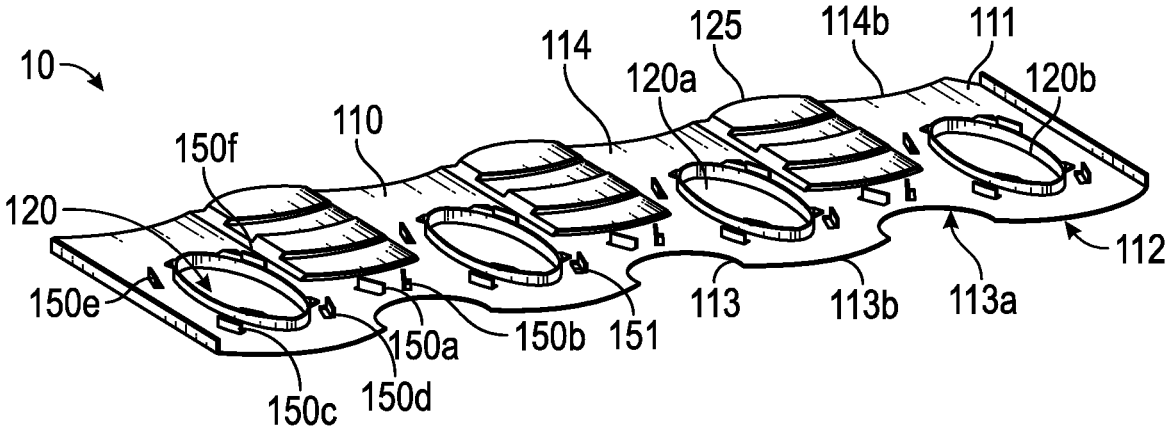
FIGS. 1A, 1B, and 1C illustrate a heat exchanger fin in accordance with example embodiments of the present disclosure at a perspective view, a top view, and a side view, respectively.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

DETAILED DESCRIPTION OF EXAMPLE EMBODIMENTS

The present disclosure is directed to a heat exchanger fin that can form part of a heat exchanger used in equipment such as in a tankless water heater, a pool heater, a refrigerator, an air conditioner, other gas to fluid heat exchangers, and other devices that utilize a finned heat exchanger. The heat exchanger fin is configured to thermally transfer heat with improved efficiency per unit of mass or unit of surface area of the fin.

Some representative embodiments will be described more fully hereinafter with example reference to the accompanying drawings that illustrate embodiments of the invention. The invention may, however, be embodied in many different forms and should not be construed as limited to the embodiments set forth herein; rather, these embodiments are provided so that this disclosure will be thorough and complete, and will fully convey the scope of the invention to those appropriately skilled in the art.

Figure 1B:
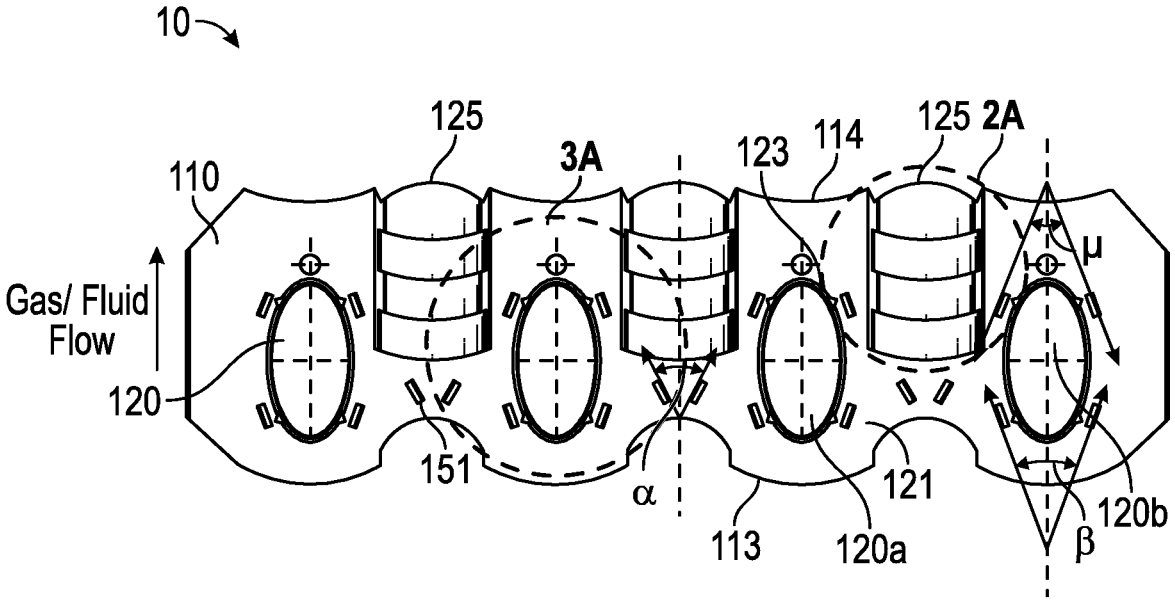
Figure 1C:
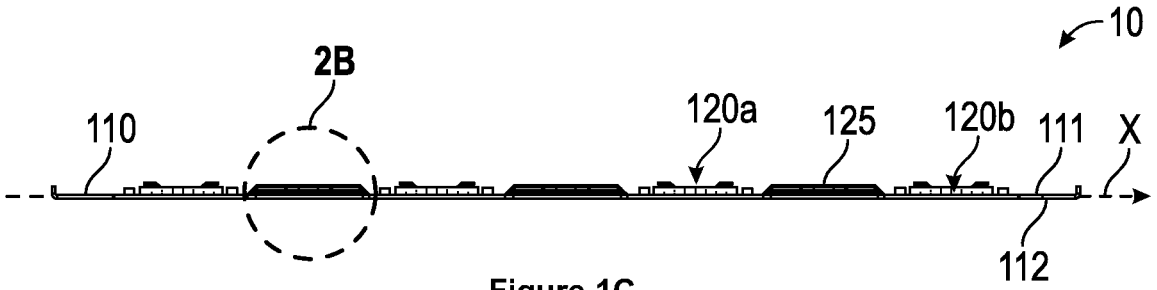
Figure 2A:
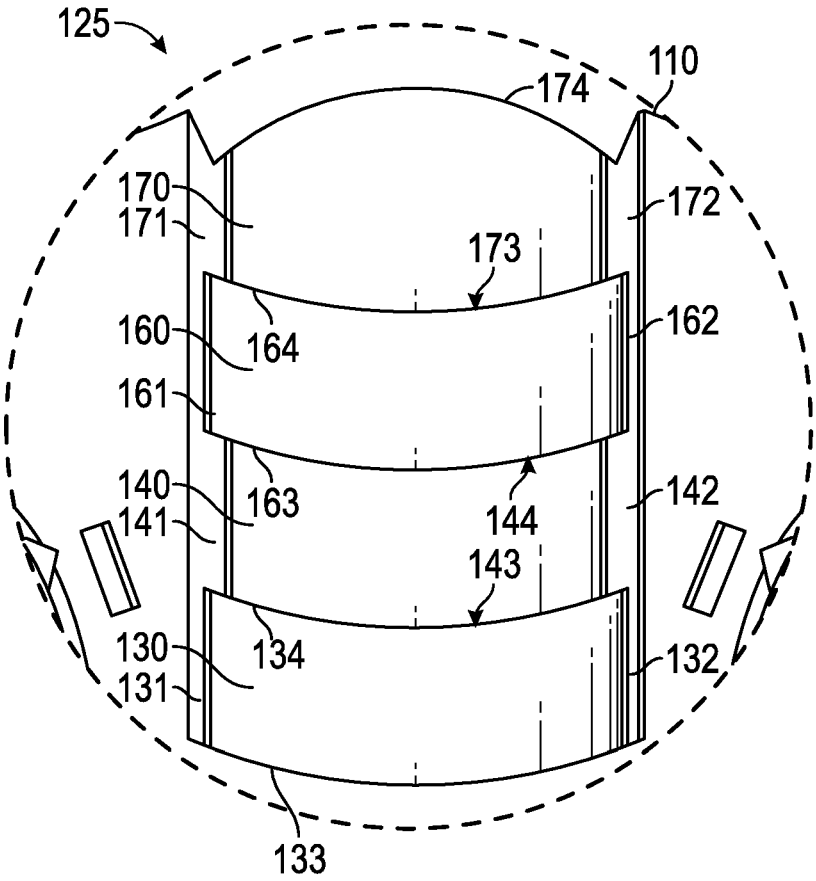
FIG. 2A illustrates a close up, top view of a section of the heat exchanger fin shown in FIGS. 1A to 1C as Detail A and comprising a louver feature.
Figure 2B:
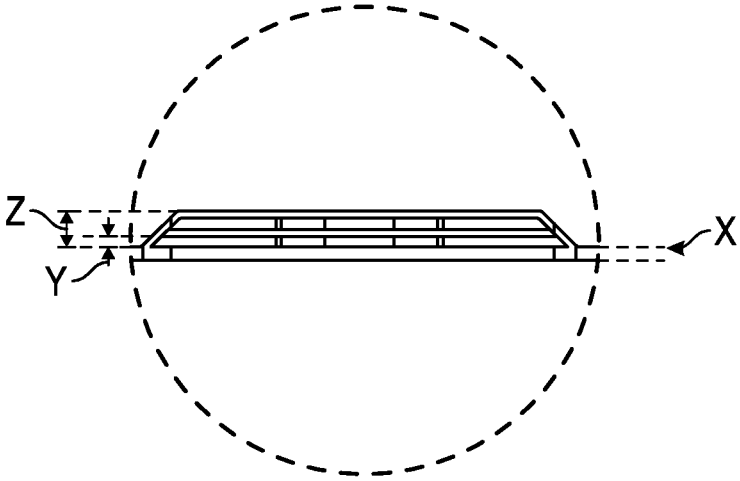
FIG. 2B illustrates a close up, cross-sectional side view of the louver feature, shown as Detail B in the embodiment shown in FIGS. 1A to 1C.
Figure 3A:
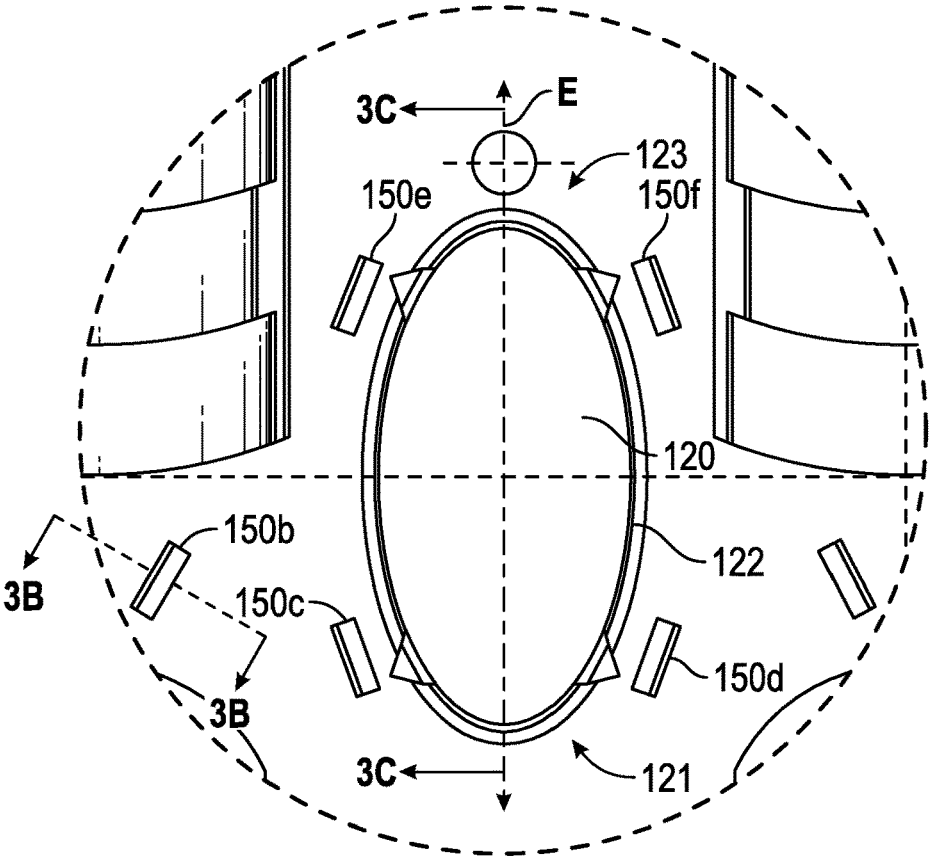
FIG. 3A illustrates a close up, top view of the heat exchanger fin shown in FIGS. 1A to 1C as Detail D and comprising a heat tube aperture and a plurality of vortex generators.
Figure 3B:
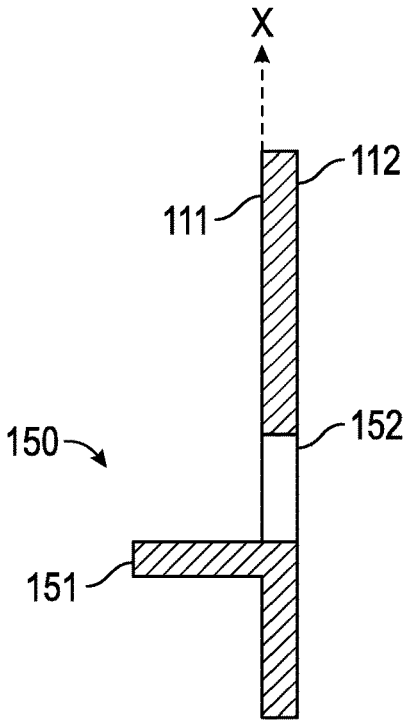
FIG. 3B illustrates a close up, cross-sectional side view of one of the vortex generators, shown as Detail F in FIG. 3A.
Figure 3C:
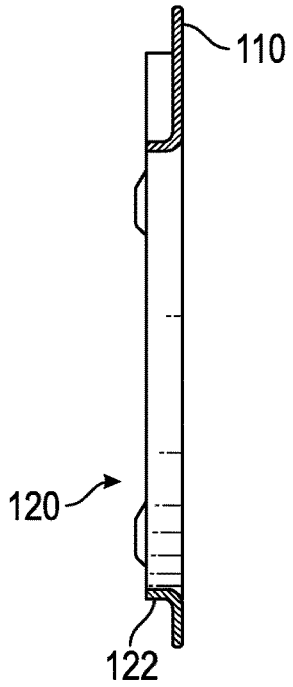
FIG. 3C illustrates a close up, side view of heating tube apertures, shown as Detail E in FIG. 3A.

Turning now to FIGS. 1A to 1C (collectively FIG. 1), 2A to 2B (collectively FIG. 2), and 3A to 3C (collectively FIG. 3), these figures describe a heat exchanger fin 10 according to some example embodiments of the disclosure. As further described below, the heat exchanger fin 10 comprises a base 110 comprising a plurality of apertures 120 each configured to receive a heat transfer tube (see e.g., tube 90 of FIG. 4) and a variety of boundary disrupting features on at least one of a first surface 111 and a second surface 112 that is opposite the first surface. Such boundary disrupting features comprise a series of louvers 125 and a plurality of vortex generators (e.g., winglet-type vortex generators 150*a* to 150*f* (generally referred to as vortex generators 150)). The described combination of surface features facilitate a heat exchanger fin, e.g., fin 10, with efficient heat transfer as compared with other fins of the same mass and/or surface area.

Heat exchanger fin 10 comprises a fin leading edge 113 and a fin trailing edge 114 and a substantially flat base plane X extending between the fin leading edge and the fin trailing edge. Fin 10 is configured such that the fin leading edge 113 is upstream of the fin trailing edge 114 during use. (When referring to a "leading edge" and a "trailing edge" for other elements described herein, it is noted that the leading edge for such component will be upstream of the trailing edge during use.) As mentioned above, fin 10 comprises a plurality of apertures 120. Apertures 120 can comprise a collar 122 that is configured to contact a heat transfer tube 90 (see FIG. 4) when such tube is extending through the aperture. As depicted, apertures 120 can be evenly spaced apart from each other.

Fin 10 comprises a series of louvers 125, e.g., a first louver 130, a second louver 140, a third louver 160, and a fourth louver 170. In the embodiment shown, a series of louvers 125 can be located in each space that is between neighboring apertures (e.g., apertures 120*a* and 120*b*). A louver is a surface feature coupled to the base 110 at a first end and a second end that is opposite the first end and comprises a leading edge and a trailing edge that are spaced apart a distance from the base plane X. For example, first louver 130 is coupled to the base 110 at a first end 131 and a second end 132. First louver 130 comprises a leading edge 133 and a trailing edge 134, and each of the first louver leading edge 133 and the first louver trailing edge 134 are spaced apart from the base plane X a first distance Y. Similarly, second louver 140 is coupled to the base 110 at a first end 141 and a second end 142 and comprises a leading edge 143 and a trailing edge 144. In the embodiment shown, each of the second louver leading edge 143 and the second louver trailing edge 144 are spaced apart from the base plane X a second distance Z. In the embodiment shown, the second louver 140 is parallel with and adjacent to the first louver 130.

A fin 10 can further comprise a third louver 160 and fourth louver 170 as part of the series of louvers 125. The third and fourth louvers 160, 170 can be similar to the first and second louvers, respectively, yet located downstream of the second louver 140. For example, third louver 160 is coupled to the base 110 at a first end 161 and a second end 162 and comprises a leading edge 163 and a trailing edge 164. Similarly, fourth louver 170 is coupled to the base 110 at a first end 171 and a second end 172 and comprises a leading edge 173 and a trailing edge 174. Like the first louver 130, each of the third louver leading edge 163 and the third louver trailing edge 164 are spaced apart from the base plane X a first distance Y. And like the second louver, each of the fourth louver leading edge 173 and the fourth louver trailing edge 174 are spaced apart from the base plane X a second distance Z. In the embodiment shown, the four louvers 130, 140, 160, 170 are parallel with each other and generally aligned in a upstream-downstream direction. The third louver 130 is downstream and adjacent the second louver 140 and the fourth louver 170 is downstream and adjacent the third louver 160.

In the embodiment shown, at least two of the louvers (e.g., first louver 130 and second louver 140 or third louver 160 and fourth louver 170) are spaced apart from the base plane X at differing distances (e.g., distances Y and Z). For example, a downstream louver (e.g., the second louver 140 or fourth louver 170) is spaced apart from base plane X at a greater distance than or about twice the distance as that of an upstream louver (e.g., first louver 130 or third louver 160).

In addition to the one or more louvers, fin 10 also comprises one or more vortex generators, such as winglet-type vortex generators 150. In some embodiments, a winglet-type vortex generator 150 can be formed from a fin stock such that a portion of the vortex generator defines an aperture 152 that is the same shape as the winglet-type vortex generator 150. The winglet-type vortex generator 150 comprises a body or winglet 151 (FIG. 3B) that is coupled to the base and projects from the surface 111, for example, at an angle to the base plane X. In the embodiment shown, the winglet 151 is perpendicular to the base plane X. In others, the angle of the winglet 151 relative to the base plane X is 40, 50, 60, 70, 80, 90 degrees, or any number therebetween. The winglet-type vortex generator 150 can comprise a constant height across its length (e.g., a rectangular shape) or vary/diminish in height across its length (e.g., a triangular shape). In the embodiment shown, the rectangular winglet 151 is coupled to the base 110 along its longer side.

One location on fin 10 where a vortex generator 150 is disposed is the area between a fin leading edge 113 and a first louver leading edge 133. For example, in the embodiment shown, a pair of rectangular type winglet-type vortex generators (referred to as the first winglet-type vortex generator 150*a* and the second winglet-type vortex generator 150*b*) are coupled to the base 110 and located between the fin leading edge 113 and the first louver leading edge 133. The pair of vortex generators 150*a* and 150*b* can be positioned at an angle to the average flow direction of fluid that will pass over the fin such that the distance between the first and second vortex generators 150*a*, 150*b* is smaller towards the fin leading edge 113 and larger towards the fin trailing edge 114. Specifically, the first winglet-type vortex generator 150*a* and the second winglet-type vortex generator 150*b* extend along a respective ray of an acute angle $\alpha$ and the rays extend toward the fin trailing edge 114. The acute angle $\alpha$ can be between 35 and 75 degrees, such as 35, 40, 45, 50, 55, 60, 65, 70, or any value therebetween. In some embodiments, the angle $\alpha$ is between 55 and 65 degrees or about 60 degrees.

Another location on fin 10 where a vortex generator 150 can be disposed is the area near the upstream end 121 of each aperture 120. For example, a pair of winglet-type vortex generators 150*c*, 150*d* is flanking each aperture 120, spaced apart from the aperture 120 or collar 122, and located nearer the fin leading edge 113 than the fin trailing edge 114. The pair of vortex generators 150*c* and 150*d* can be positioned at an angle to the average flow direction of fluid that will pass over the fin such that the distance between the vortex generators 150*c* and 150*d* is smaller towards the fin leading edge 113 and larger towards the fin trailing edge 114. Specifically, the pair of winglet type vortex generators 150*c* and 150*d* near the upstream end 121 extends along a respective ray of a second acute angle $\beta$ and the rays extend toward the fin trailing edge 114. The second acute angle $\beta$ can be between 35 and 75 degrees, such as 35, 40, 45, 50, 55, 60, 65, 70 degrees, or any value therebetween. In some embodiments, the angle $\beta$ is between 35 and 45 degrees or about 40 degrees.

Yet another location on fin 10 where a vortex generator 150 can be disposed is the area near the downstream end 123 of each aperture 120. For example, a pair of winglet-type vortex generators 150*e*, 150*f* is flanking each aperture 120, spaced apart from the aperture 120 or collar 122, and located nearer the fin trailing edge 114 than the fin leading edge 113. The pair of vortex generators 150*e* and 150*f* can be positioned at an angle to the average flow direction of fluid that will pass over the fin such that the distance between the first and second vortex generators 150*e* and 150*f* is smaller towards the fin trailing edge 114 and larger towards the fin leading edge 113. Specifically, the pair of winglet type vortex generators 150*e* and 150*f* near the downstream end 123 extend along a respective ray of a third acute angle $\mu$ and the rays extend toward the fin leading edge 113. The third acute angle $\mu$ can be between 35 and 75 degrees, such as 35, 40, 45, 50, 55, 60, 65, 70 degrees, or any value therebetween. In some embodiments, the angle $\mu$ is between 35 and 45 degrees or about 40 degrees.

In some embodiments, each of the plurality of apertures 120 can be circular or oblong (e.g., elliptical). In one example embodiment of the heat exchanger fin shown in FIGS. 1A-3C, the apertures 120 are oval with a major (longitudinal) axis/minor axis ratio of 1.4. Each of the plurality of apertures 120 is configured so that a major (longitudinal) axis E (FIG. 3A) of the aperture is parallel with an average direction of gas flow over the heat exchanger fin and around the exterior of the heat transfer tubes. The aperture 120 can also be nearer the fin leading edge 113 than the fin trailing edge 114.

In some embodiments, to reduce the amount of material required for a fin, the edges 113, 114 of the fin 10 can have cut outs of material. For example, each section 113*a* of the fin leading edge 113 that is between two apertures 120 can be concave. Each section 114*b* of the fin trailing edge 114 that is downstream of an aperture can be concave. Conversely, each section 113*b* of the fin leading edge that is upstream of an aperture 120 can be convex.

Figure 4:
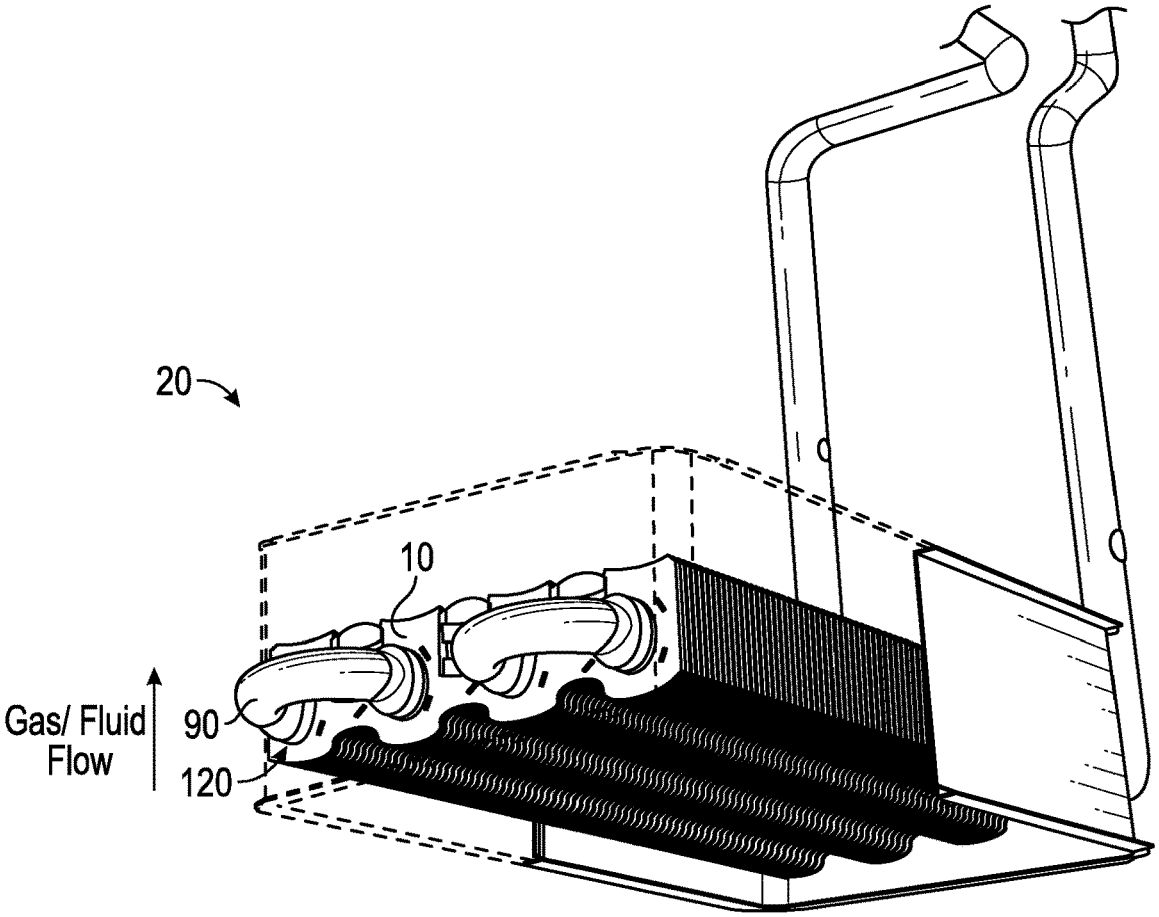
FIG. 4 illustrates a perspective, cut-away view of an embodiment of a heat exchanger incorporating the heat exchanger fin shown in FIGS. 1A to 1C.

Another aspect of the present disclosure is a heat exchanger 20 as shown in FIG. 4, which comprises a plurality of fins 10 as described above arranged substantially in parallel and one or more heat transfer tubes 90 arranged substantially perpendicular to the plurality of fins. Each tube 90 passes through one or more apertures 120 in the plurality of fins 10.

Testing of the different configurations of the louvers and winglet-type vortex generators has indicated that the positions of the features shown in FIGS. 1A-3C provides substantially improved heat transfer efficiency. In particular, the arrangement of the four louvers between each aperture, the location of the four winglet-type vortex generators surrounding each aperture, the location of the two angled winglet-type vortex generators between the louvers and the leading edge of the heat sink fin, and the concave cut outs located at the leading edge of the heat sink fin between each aperture combine to optimize the heat transfer efficiency of the heat sink fin while minimizing the amount of material required to construct the heat sink fin.

Figure 5:
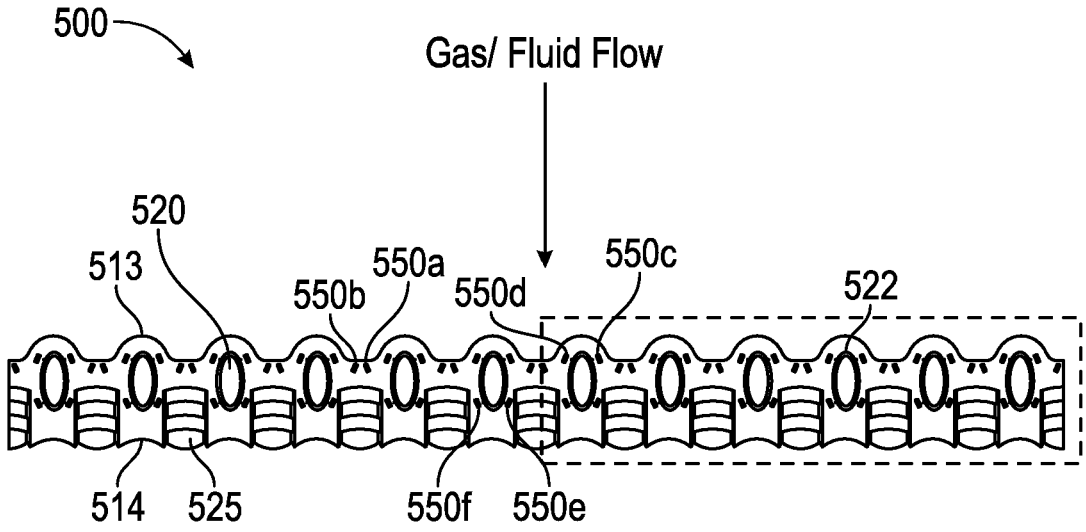
FIG. 5 illustrates a heat exchanger fin in accordance with another example embodiment of the present disclosure.

Another example embodiment of the heat exchanger fin is illustrated in FIG. 5. The example heat exchanger fin 500 shown in FIG. 5 is substantially similar to the heat exchanger fin 10 described previously, except that heat exchanger fin 500 is longer. In one example, heat exchanger fin 500 is suitable for a pool heater. The foregoing discussion of the features of exchanger fin 10 generally applies to heater exchanger 500 shown in FIG. 5. Accordingly, the features of heat exchanger fin 500 will only be briefly described.

Heat exchanger fin 500 comprises a leading edge 513 and a trailing edge 514. As shown in FIG. 5 heat transfer fluid, such as a hot gas resulting from combustion, contacts the leading edge 513 first, passes over the features of the heat exchanger fin 500, and then passes over the trailing edge 514. Similar to heat exchanger fin 10, heat exchanger fin 500 comprises a series of louvers 525 located along the trailing edge 514 of the heat exchanger fin 500. As with the louvers in heat exchanger fin 10, the louvers 525 shown in FIG. 5 comprise a series of surfaces that are spaced apart from the base plane of the heat exchanger fin 500 thereby slowing the flow of a heat transfer fluid over the surface of the heat exchanger fin 500. As can be seen in FIG. 5, the louvers 525 are positioned between apertures 520 along the length of the heat exchanger fin 500. Heat exchanger fin 500 differs from heat exchanger fin 10 in that its longer length accommodates more apertures 520, each of which receives a heat transfer tube. The apertures can also comprise a collar 522 around the perimeter of each aperture, the collar 522 being designed to secure the heat transfer tube passing through the aperture 520. The shape of the apertures can vary, however, in the example embodiment of FIG. 5, the apertures 520 are oval with a major axis/minor axis ratio of 1.4.

Heat exchanger fin 500 also comprises an arrangement of winglet-type vortex generators 550*a*-550*f* that are similar to the vortex generators 150*a*-150*f* of heat exchanger fin 10. As in the previous embodiment, the example in FIG. 5 shows the vortex generators located between the apertures 520 and surrounding the apertures 520. It should be understood that in alternate versions of the example heat exchanger fin 500, the number and placement of louvers and vortex generators can vary.

Figure 6:
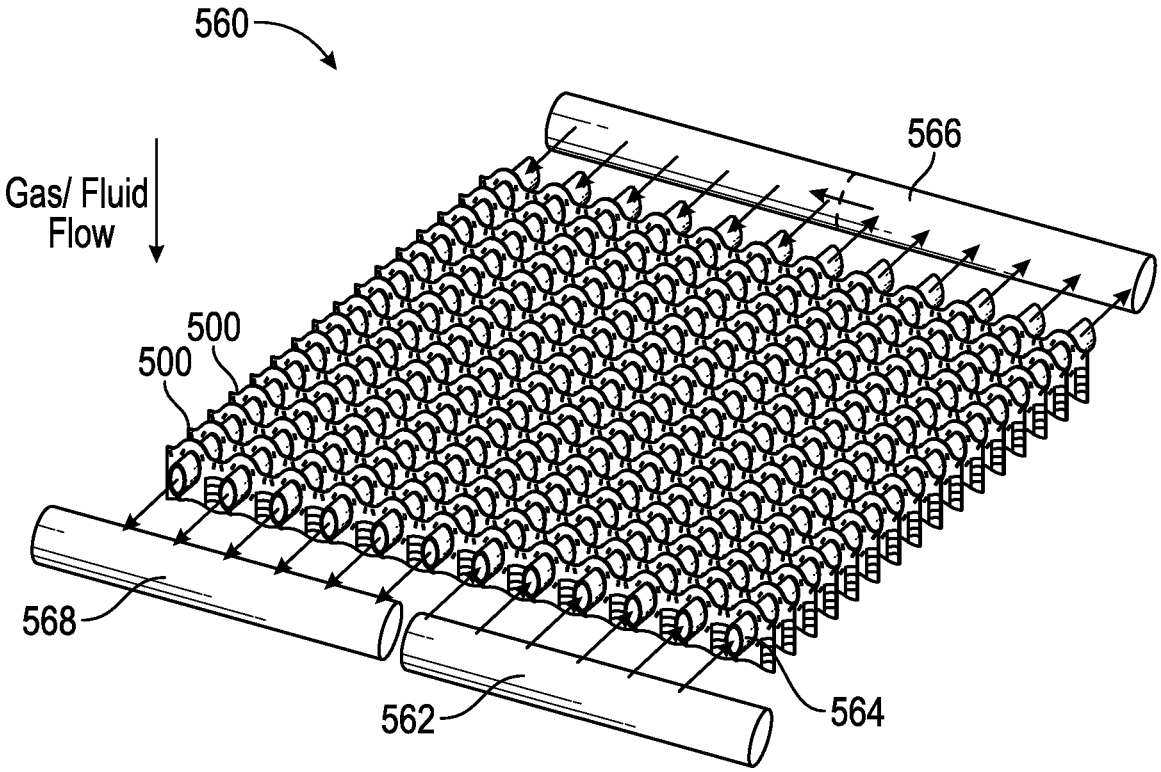
FIG. 6 illustrates a heat exchanger incorporating the heat exchanger fin of FIG. 5 in accordance with an example embodiment of the present disclosure.

Referring now to FIG. 6, a heat exchanger 560 comprising the example heat exchanger fins 500 is illustrated. Heat exchanger 560 can be used in a pool heating system as one example. Passing through each aperture 520 in the array of heat exchanger fins 500 is a heat transfer tube 564. The example shown in FIG. 6 shows the flow of water through the heat exchanger 560. As shown in FIG. 6, water flows from inlet pipe 562 into a first portion of the heat transfer tubes 564. As the water flows through the first portion of heat transfer tubes 564, it is heated by a hot gas passing through the heat exchanger fins 500 and over the outsides of the heat transfer tubes 564. The shape and position of the louvers and vortex generators on the surface of the heat exchanger fins 500 optimizes the transfer of heat from the hot gas to the water flowing within the heat transfer tubes 564. As shown by the arrows in FIG. 6, the example heat exchanger 560 is configured for the water to make two passes by exiting the first portion of the heat transfer tubes 564, passing through intermediate tube 566 and then passing through a second portion of the heat transfer tubes 564, before exiting through outlet pipe 568.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A heat exchanger fin comprising:

a base having a fin leading edge and a fin trailing edge, the fin leading edge being configured to be upstream of the fin trailing edge when the heat exchanger fin is installed in a heat exchanger;

a plurality of apertures disposed in the base, each of the plurality of apertures being configured to receive a corresponding heat transfer tube of the heat exchanger;

a first louver disposed on the base and comprising a first louver leading edge and a first louver trailing edge, the first louver leading edge being convex and the first louver trailing edge being concave;

a pair of leading edge winglet-type vortex generators flanking each aperture of the plurality of apertures and located nearer the fin leading edge than the fin trailing edge; and a pair of trailing edge winglet-type vortex generators flanking each aperture of the plurality of apertures and located nearer the fin trailing edge than the fin leading edge;

wherein the pair of leading edge winglet-type vortex generators defines a first angle therebetween, and the pair of trailing edge winglet-type vortex generators defines a second angle therebetween, wherein the first angle and the second angle are between about 35° to about 75°.

2. The heat exchanger fin of claim 1 further comprising:

a second louver disposed on the base, the second louver comprising a second louver leading edge and a second louver trailing edge, wherein a second distance between the second louver leading edge and the second louver trailing edge is greater than a first distance between the first louver leading edge and the first louver trailing edge.

3. The heat exchanger fin of claim 1 further comprising:

a second louver disposed on the base, the second louver comprising a second louver leading edge and a second louver trailing edge, the second louver leading edge being convex and the second louver trailing edge being concave.

4. The heat exchanger fin of claim 1 further comprising:

a winglet-type vortex generator located between the fin leading edge and the first louver leading edge.

5. The heat exchanger fin of claim 4, wherein the winglet-type vortex generator comprises a rectangular winglet.

6. The heat exchanger fin of claim 4, wherein the winglet-type vortex generator comprises a triangular winglet.

7. The heat exchanger fin of claim 1, wherein the first angle between the pair of leading edge winglet-type vortex generators is about 40°.

8. The heat exchanger fin of claim 1, wherein the second angle between the pair of trailing edge winglet-type vortex generators is about 40°.

9. The heat exchanger fin of claim 1, wherein each aperture of the plurality of apertures is oblong and oriented such that a longitudinal axis of the aperture is parallel with an average direction of upstream to downstream flow of gas over the heat exchanger fin when the heat exchanger fin is installed in the heat exchanger.

10. The heat exchanger fin of claim 1, wherein a section of the fin leading edge between adjacent apertures of the plurality of apertures is concave.

11. The heat exchanger fin of claim 1, wherein a first section of the fin leading edge that is upstream of an aperture of the plurality of apertures is convex and a second section of the fin trailing edge that is downstream of an aperture of the plurality of apertures is concave.

* * * * *